United States Patent [19]

Tracy

[11] 4,099,595

[45] Jul. 11, 1978

[54] ESCAPE DEVICE

[76] Inventor: Thomas Ray Tracy, 2175 Fairmeadow Dr., Boise, Id. 83704

[21] Appl. No.: 678,641

[22] Filed: Apr. 20, 1976

[51] Int. Cl.[2] ..... A62B 1/20

[52] U.S. Cl. ..... 182/48

[58] Field of Search ..... 182/48, 49, 82; 193/25 R, 25 C

[56] References Cited

U.S. PATENT DOCUMENTS

| | | | |
|---|---|---|---|
| 515,106 | 2/1894 | Bouvier | 182/48 |
| 913,117 | 2/1909 | Feyma | 182/49 |
| 1,774,223 | 8/1930 | Beucler | 182/49 |
| 2,270,437 | 1/1942 | Herendeen | 182/49 |
| 3,348,630 | 10/1967 | Yamamoto | 182/48 |
| 3,595,510 | 7/1971 | Hutchinson | 182/82 |
| 3,679,026 | 7/1972 | Hansen | 182/82 |
| 3,977,497 | 8/1976 | Zephinie | 182/48 |
| 3,994,366 | 11/1976 | Okuma | 182/48 |

FOREIGN PATENT DOCUMENTS

| | | | |
|---|---|---|---|
| 9,947 of | 1908 | United Kingdom | 182/48 |

*Primary Examiner*—Reinaldo P. Machado

*Attorney, Agent, or Firm*—Strauch, Nolan, Neale, Nies & Kurz

[57] ABSTRACT

An escape chute comprising a frame adapted to be secured to a window opening or the like and a releasable pack chute containing spaced resilient transverse restriction bands for cushioning the descent of a body through the released chute.

6 Claims, 10 Drawing Figures

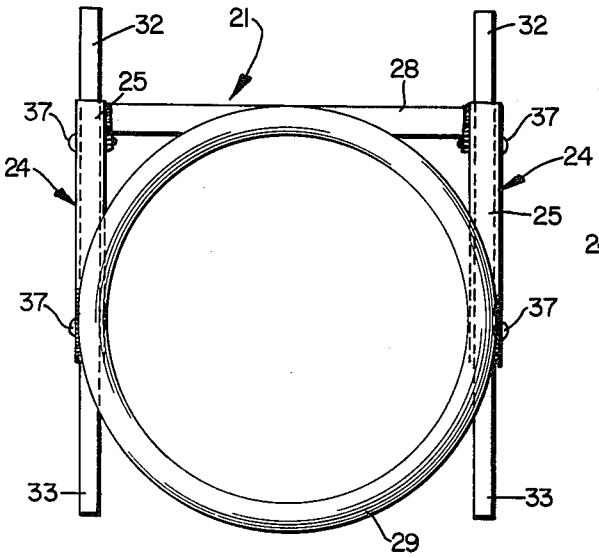
FIG. 1
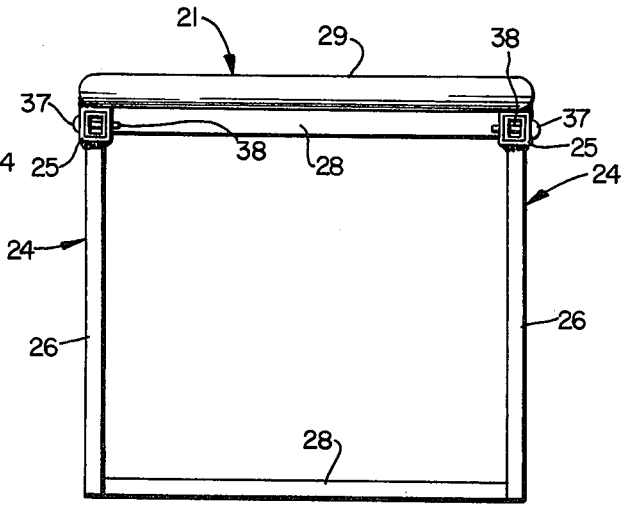
FIG. 2
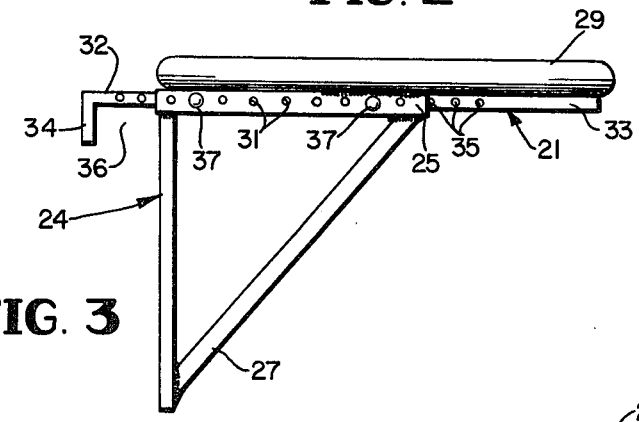
FIG. 3
FIG. 4
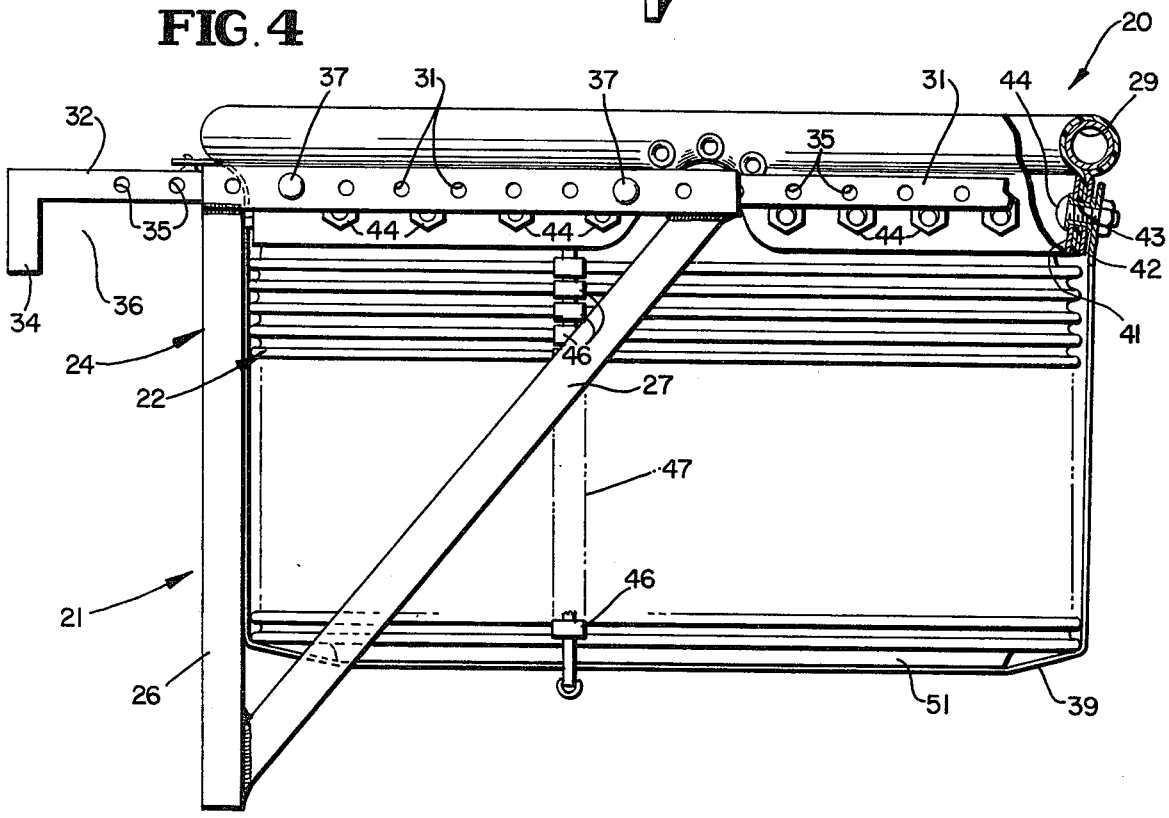

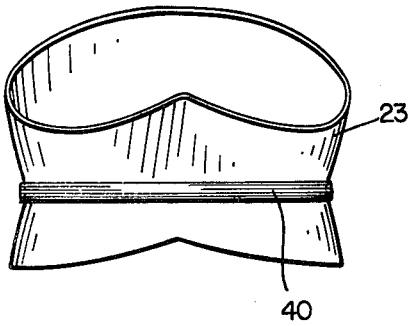
FIG. 8
FIG. 10
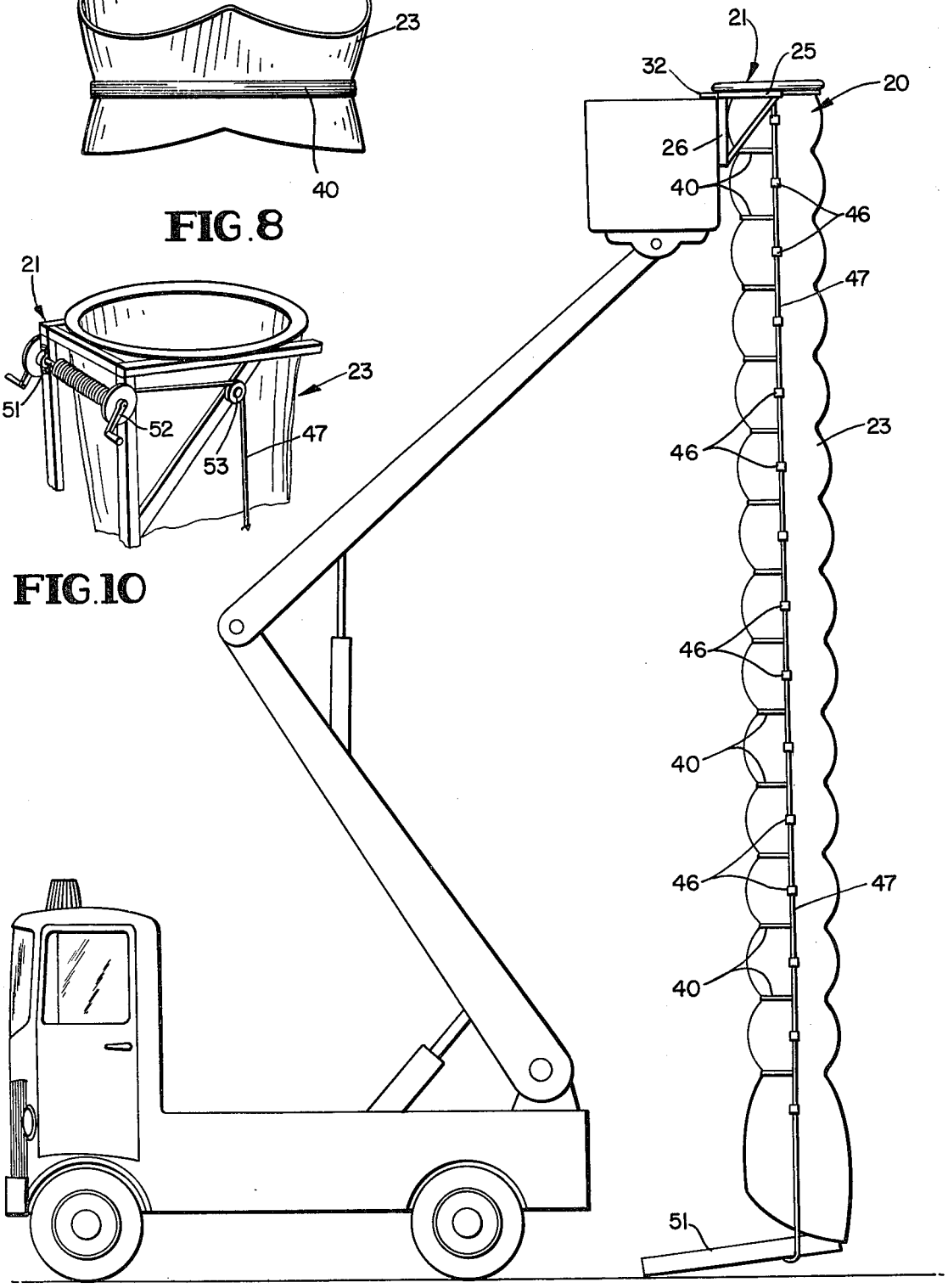
FIG. 9

ESCAPE DEVICE

BACKGROUND OF THE INVENTION

The present invention is directed to an escape device assembly of the chute type exemplified by United States Letters Pat. No. 459,319 to P. Thoresen dated Sept. 8, 1891; 515,106 to N. Bouvier et al dated Feb. 20, 1894; 3,348,630 to M. Yamamoto dated Oct. 24, 1967; and 3,580,358 to M. Yamamoto dated May 25, 1971. Such chute type escape devices are intended to enable persons occupying a multi-storied building to safely escape from the upper floors when the normal egress facilities such as stairways, elevators, and permanently installed fire escapes are made inaccessible or unusable by reason of fire, buidling damage due to windstorms, structural failure, or like catastrophic conditions. When such conditions rendering normal egress facilities unusable occur, the building occupants can often safely reach window openings or the building's roof where the outer building walls provide an upstanding wall portion to which: (1) a stored chute escape device can be secured to provide an emergency egress path of (2) an aerial ladder or the extensible bucket of a "cherry picker" resuce vehicle fitted with such an escape device can be adjacently positioned to remove those trapped, particularly those who, because of acrophobia, are unable to descent an aerial ladder or safely enter a raised "cherry picker" bucket.

SUMMARY OF INVENTION

It is a principal object ot the present invention to provide a chute type escape device comprising a tubular chute of high strength flexible material fixedly connected at one end to an annulus supported in spanning relation by respective spaced, dependent end frame members formed to provide protuberant axially adjustable, hangar support arms, said chute being interfolded lengthwise to form a chute pack disposed between the end frame members to form a convenient assembly for storage.

More particularly, the present invention resides in the provision of a chute structure according to the previous object wherein the tubular chute of high strength flexible material is provided at longitudinally spaced intervals with semicylindrical resilient bands of a lesser length than half the circumference of the chute fixedly secured at their respective ends to the chute material at longitudinally aligned, diametrically opposed points to thereby form axially spaced restricted areas operative to yieldingly emcompass the opposing portion of a freely descending body within the chute and decelerate or brake the speed of descent.

A further object of the present invention resides in providing the chute structure of the preceding object with respective strap hooks inset inwardly within the chute end remote from the one end fixed to the annulus in axial alignment with the semi-cylindrical resilient bands and securing to the strap hooks the respective end mounted hangar straps of an elongated matress-like cushion thereby connecting the cushion in end-to-end, downwardly inclined, spanning relation to the remote chute end to serve to cushion the slowed falling body as it emerges from the remote end of the chute at ground level.

Another object of the present invention resides in forming the respective, spaced dependent frame members of this invention of runs of tubular metal stock interconnected to provide parallel annulus supporting runs and cross drilled at longitudinally spaced, opposed intervals to receive securing pins and depending parallel, right angularly related abutment runs; respective L-shaped hangar support bars the longer legs of which are cross-drilled at equidistantly spaced intervals fitted into said annulus supporting runs a preselected distance in an orientation to dispose the respective short legs in depending, opposed, spaced relation to the right angularly related abutment runs to define downward-opening clamp sockets for securing the escape device to a support structure in operative position to a viable egress point of a building; and securing pins cooperatingly associated in the cross-drilled openings of the annulus support runs and longer legs of said hangar support bars to secure the hangar support bars in their preselected telesscoped position.

BRIEF DESCRIPTION OF THE DRAWINGS

Further objects will appear from the following description and appended claims when read in conjunction with the accompanying drawings wherein:

FIG. 1 is a top plan view of the support frame of an escape device according to an embodiment of this invention;

FIG. 2 is a front elevational view of FIG. 1;

FIG. 3 is a side elevational view of FIG. 1;

FIG. 4 is a side elevational view of the escape device illustrating the manner in which the chute is attached to the support frame of FIG. 1 and endwise interfolded into pack form and secured for unit storage;

FIG. 8 is a fragmental elevational view of the extended chute as viewed from the left of FIG. 6 showing the manner of securing the semi-cylindrical restriction of the chute diameter by use of the resilient bands of lesser than semicylindrical chute dimension end secured to diametrically opposed points in the chute circumference;

FIG. 9 is a schematic view of a so-called "cherry-picker" rescue truck with the escape device mounted on the bucket side wall; and FIG. 10 is a fragmentary view showing a chute adjustment adapting it to different floor levels.

DESCRIPTION OF THE PREFERRED EMBODIMENT

Figure 6:
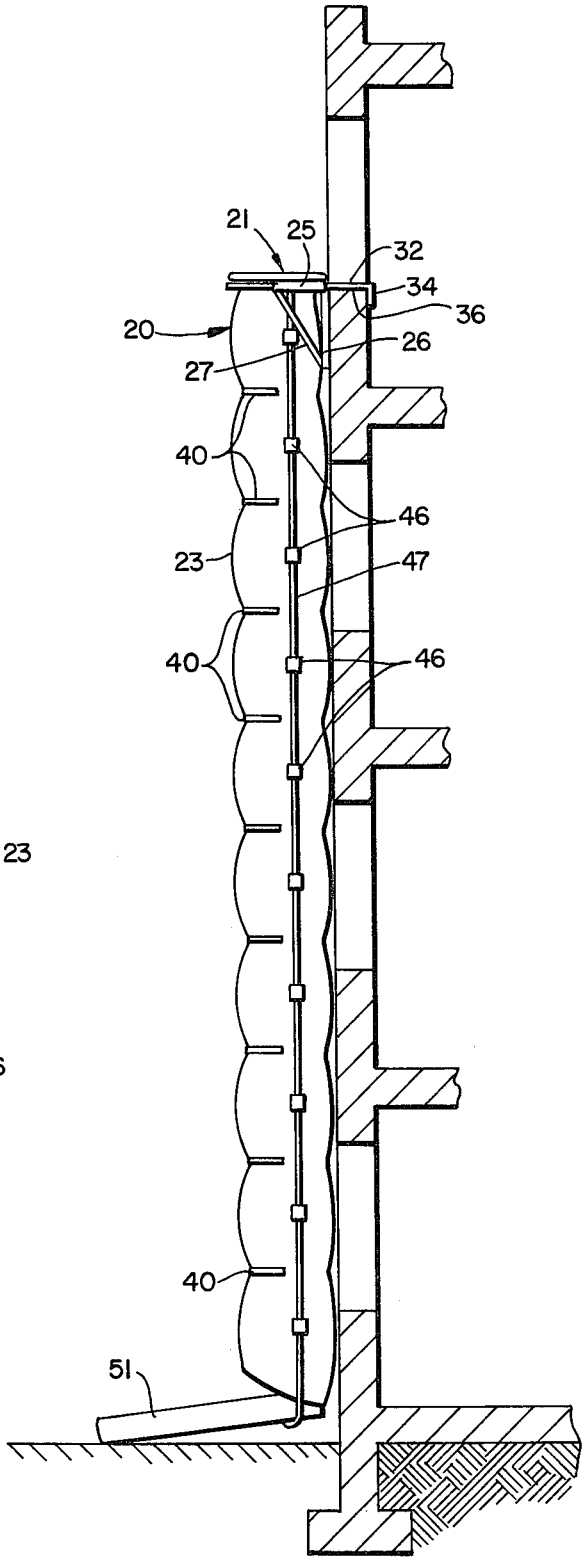
FIG. 6 is a side view of the escape device in operative open position with the support frame hangar bars mounted on the sill of a fourth story window of a building structure.

With continued reference to the drawings wherein the same reference numerals are employed throughout the several views to indicate the same parts, the numeral 20 designates in general an escape device made in accord with this invention (See FIGS. 4, 6 and 9). The escape device 20 is composed of two principal parts, a support frame 21 and an extensible, interofolded chute pack 22 (FIG. 4). While the overall dimensions may be varied considerably, particularly the extended length of the chute 23 itself, which can be from about thirty feet, if designed for a fifteen story building or still greater length for even taller buildings, the chute diameter is preferably of the order of 28 inches and uniform from end-to-end. A chute of this diameter is contemplated to effectively accomodate individulas of widely varying girth likely to be encountered in day-to-day usage of the escape device. As will presently appear, the approximate 90 inch outer circumference of such a chute 23 made of a preferred 100 lb. test, lightweight nylon plastic material yieldingly restricted at longitudinally spaced intervals as hereinafter described should safely accomodate a reasonable wide range of users.

Referring for the moment to FIGS. 1 through 3, support frame 21 designed to support chute 23 in use as well as the chute pack 22 for storage is of skeletal construction made of solid and tubular steel or aluminum stock. It comprises respective end frame members 24 each made up of a tubular annulus or ring support run 25, a dependent bar stock abutment leg 26 end butt connected to the underside of support run 25 at one end by welding or other suitable fastening means and an inclined bar stock' reinforcing strut 27 end butt connected to the underside free end of support run 25 and the free end of abutment leg 26 (FIGS. 3 and 4). The respective end frame members 24 are cross-connected by bar stock tie bars 28 (FIGS. 1 and 2) end butt connected to the inside faces of the free ends of abutment legs 26 and the inside faces of support runs 25 at the ends opposite their free ends, Should additional reinforcing be deemed desirable, respective gusset plates (not shown) can be installed in the included angles defined by the intersecting ends of abutment legs 26 and struts 27, struts 27 and support tuns 25, abutment legs 26 and support runs 25, and abutment legs 26 and tie bars 28.

While the dimensions of the parts 25, 26, 27 and 28 may vary depending upon the diameter chosen for the chute 23, a support frame for the 28 inch diameter chute here disclosed preferably includes support runs 25 of 1 $\frac{1}{4}$ inch square tubular steel or aluminum 8 inches in length, abutment legs 26 of 1 $\frac{1}{4}$ inch square steel or aluminum bar stock 24 inches in length, reinforcing struts 27 of 1 $\frac{1}{4}$ inch square steel or aluminum bar stock 27 $\frac{1}{2}$ inches in length, and tie bars 28 of 1 $\frac{1}{4}$ inch steel or aluminum bar stock 28 inches in length.

As best shown in FIGS. 1 through 3, an annulus or ring 29 of 1 $\frac{7}{8}$ inch tubular steel or aluminum having a circumference of 90 inches is superimposed on the upper faces of support runs 25 and upper tie bar 28 and fixed thereto by welding the overlapping portions of the annulus to the faces of support runs 25 and upper tie bar 28. To adapt support frame 21 for mounting and use, the support runs 25 are cross drilled at longitudinally spaced intervals, preferably 2 inch intervals, as indicated by numeral 31 (FIGS. 3 and 4). L-shaped clamp bars 32 of square bar stock having a similarly cross drilled long leg 33 dimensioned to slidingly fit within the respective support runs 25 with the short leg 34 directed downwardly (See FIGS. 3 and 4) completes the support frame. As best shown in FIG. 3, legs 33 of clamp bars 32 are of a length substantially greater than the 18 inch length of support runs 25. Legs 33 are through cross drilled at spaced two inch intervals 35 adapting leg 33 of clamp bars 32 to be adjustably positioned lengthwise of support runs 25 to define between short leg 34 and the opposed abutment legs 26 respective downwardly opening clamp sockets 36 of varying length. Suitable headed lock pins 37 (FIGS. 3 and 4) having shanks 38 (FIG. 2) fitted through aligned drilled passages 31 and 35 are provided to lock clamp bars 32 in any one of a plurality of selected positons to establish clamp sockets 36 of an appropriate length to closely receive a support structure for mounting the escape device 20 in juxtaposition to an accessible egress point of the building.

Assuming egress from a building could be made through a window opening of a building or a roof enclosed by an upstanding wall structure or a sturdy guard rail and the escape device was accessible to the trapped persons, support frame 21, with chute pack 22 suspended from annulus 29 as shown in FIG. 4, could be mounted on the sill of an open window or the upstanding roof enclosing wall structure or guard rail by adjustably positioning clamp bars 32 to form a clamp socket 36 of a length to closely receive the sill, upstanding wall structure or guard rail. When properly adjusted to form a closely receiving clamp socket 36, the frame 21 and associated stored chute pack 22 releasably secured in interfolded stored relation by one or more securing straps 39 (FIG. 4) are passed outwardly through the window or across the upstanding wall structure or guard rail and lowered as a unit to engage the sill, wall structure, or guard rail in sockets 36 with the abutment legs 26 engaging the outer face of the building wall or guard rail and leg 34 of clamp bar 32 engaging the inner face of the building wall or guard rail. When firmly seated, the chute pack 22 is released, as will be presently pointed out, permitting the lengthwise interfolded chute 23 to gravitate downwardly until its lower end reaches the ground and the chute 23 is fully unfurled.

While the support frame 21 may be employed with an infolded chute pack 22 of any suitable material and may be employed to mount the escape device 20 on the sidewall of a conventional "cherry picker" type rescue vehicle as illustrated in FIG. 9 of the drawings or even the extension ladder of a conventional fire truck where one of the devices 20 is not accessible to the trapped victims, the present invention contemplates a chute 23 of high strength plastic material such as nylon constructed as hereinafter described. This particular chute structure is highly preferred since it is light in weight, a four story chute 23 weighing about 8 $\frac{1}{2}$ pounds; a 1 inch $\times$ 6 inch sample specimen will withstand a pressure force of 100 pounds without tearing; the material will not rip and will not rot, or mildew during storage and will dry quickly after wetting; may be securely sewn using heavy commercial grade "Dacron" thread; and when fitted, as hereinafter described, with resilient, semi-cyclindrical, restricting bands at three foot longitudinally spaced intervals and a mattress-like, cushioning landing pad suspended from lengthwise directed nylon straps, will fall into natural, longitudinal folds assuring a "snag free" slide area and will effectively snub or brake the descent of a free falling body assuring a safe speed of descent and cushioned landing of the rescued victims in a prone position on the mattress-like cushioning landing pad.

Referring for the moment to FIGS. 4 through 8, the chute 23 is made up of two lengths of 45 inch nylon sheeting joined along their longitudinal edges by machine stitching using heavy commercial grade "DACRON" thread. The preferred steps of construction consist of joining a first pair of overlapped panel edges by machine stitching while incorporating into the joining seam at three foot intervals one end of respective elastic belts 40 (FIG. 6) of a length substantially less then the forty five inch width of the respective nylon sheets. After joining the two panels to form a two panel assembly ninety inches wide, respective ninety inch by four inch strips 41 and 42 (FIG. 4) of heavy canvas are stitched in cross wise, longitudinally spaced relation respectively to one face of the two panel assembly at one end and inwardly from the one end at a spacing of about four inches from strip 41. Strips 41 and 42 and the underlying nylon are then pierced at four inch intervals lengthwise of strips 41 and 42 and fitted with grommets 43 dimensioned to pass the shanks of respective ⅜ inch by 1 inch bolts 44 (FIG. 4).

While the two panel assembly, still joined along the first pair of overlapped panel edges only to form a ninety inch wide panel, is laid out with the one face uppermost, respective sets of longitudinally aligned belt loops 46 (FIG. 6) spaced longitudinally midway between elastic belts 40 and along the longitudinal center line of the respective panel halves are stitched in place to provide longitudinally aligned loop passages dimensioned to freely pass respective nylon belts 47 (FIG. 6) extending from end-to-end of the panel halves. Belts 47 are machine stitched at adjacently related ends to the respective canvas strips 41, passed successively through the respective aligned belt loops 46 (FIG. 6) to dispose their opposite free ends fitted with respective snap hooks 48 (FIG. 7) depending at the opposite end of the two panel assembly.

The two panel assembly is completed to form chute 23 by overlapping the opposite longitudinal edges of the two panel assembly and machine stitching the final pair of overlapped panel edges while incorporating into the resulting further joining seam at three foot intervals the free ends of the respective elastic belts 40 (FIG. 6). Since elastic belts 40 are of a length substantially less than forty five inches, the panel section spanned laterally by belts 40 will be "in folded" deeply inwardly at the longitudinally spaced belted areas (See FIG. 8) to form expandable restricting areas every three feet along the length of chute 23, the chute 23 should be secured to annulus or ring 29 oriented so the "in folded" panel section is faced by the rescue victim descending feet first.

In this position the feet of the victim straddle the "in fold" with the heels engaging the unrestricted portion of chute 23 avoiding any possibility of the heels catching on the resilient belts to arrest the controlled descent. Assuming the escape device to be mounted on the window ledge or roof top wall of the building where the victim is trapped as in FIG. 6, or on the side wall of the bucket of a "cherry picker" rescue vehicle or the extension ladder of a fire engine, raised to incline toward the building wall as shown in FIG. 9, the "in folded" panel section should be disposed away from the building wall to assure proper entry for descent. Rescue personnel at ground level can then manually shift the discharge end of the chute outwardly from the wall to clear shrubbery or other obstacles that may be near the wall at ground level. The victim, when instructed to enter the chute facing outwardly from a sitting position on the window sill or roof top wall with his body held rigid, arms close to the body, and feet at opposite sides of the "in fold" of the chute, will be assured of a proper descent. The victim's heels will pass freely each successive restricted area while the fore part of the feet straddling the "in fold" will pass the braking belts 40 while stress free thus avoiding foot or heel entanglement strictures. Once the feet pass the braking belts 40, the legs and body entering the restricted area will first distend the belt free wall of the chute canting the body so the upper portion of the legs and hips acting against the "in fold" and secured ends of braking strips 40 will build up braking tension slowing the descent at successive three foot intervals by restrictive expansion of the restricted semi-cylindrical wall.

Figure 5:
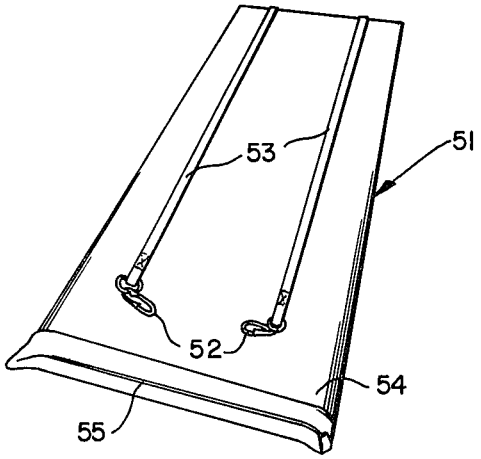
FIG. 5 is a perspective view of the mattress-like cushion removed from its association with the chute proper to illustrate the simplicity of its construction.
Figure 7:
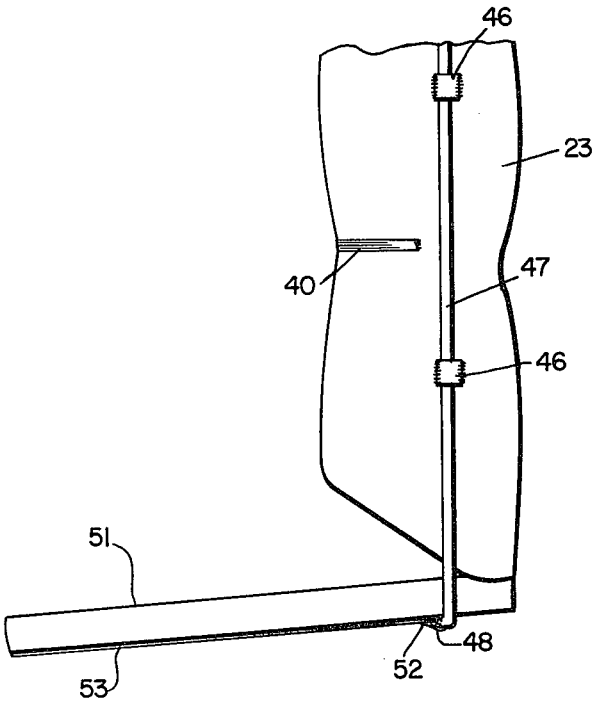
FIG. 7 is a fragmental view showing how the mattress-like cushion is secured in place within the lower or egress end of the chute.

To assure shock free discharge from the lower end of chute 23, the present invention contemplates that an elongated landing pad 51 (FIGS. 4, 5 and 6) be secured to the snap hooks 48 at the lower ends of nylon belts 47 by means of rings 52 as shown in FIGS. 5 and 7 secured to the underside upper ends of lengthwise canvas straps 53 stitched to a nylon cover 54 enclosing an elongated foam rubber pad preferably eight inches thick, twenty four inches wide and 72 inches long. Cover 54 is preferably formed along its upper end and along one side with a zipper type closure element 55 (FIG. 5). As will be clear from FIG. 6, landing pad 51 extends downwardly and outwardly at a slight inclination from the lower end of chute 23 when the escape device is positioned for use to assure that the victim lands in a normal reclining position. It follows, therefore, that the chute of this invention can also be safely used to remove injured victims who can be strapped into a mattress or other protective padding and lifted into the desired position to enter the chute of the escape device by rescue personnel occupying the bucket of a conventional "cherry picker" rescue vehicle or standing on an extension ladder of a conventional ladder truck.

From the foregoing description, it will be appreciated that the escape device of the present invention is effectively designed to minimize, if not eliminate, hazardous foot and heel entanglement structures that have on occasion resulted in traumatic rescue attempts where full encircling elastic restricting bands are employed, particularly where the rescue victim may have, either because of injury or fear become entangled in a chute type escape device.

FIG. 10 illustrates an arrangement whereby the invention includes a winch adapting it for different floor levels. The support frame 21 rotatably mounts a transverse shaft 51 provided with a winding handle 52. The upper ends of belts 47 pass over centered pulleys 53 and are secured upon shafts 51. Thus the bottom end of the pack may be lowered to the ground to suit the height of frame 21, the upper part of the pack remaining folded where the drop is shorter than the ultimate length of chute 23. Preferably a suitable ratchet mechanism 54 is provided between the shaft and the adjacent frame to lock the shaft in a desired position of rotation.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An escape chute adapted for rescuing persons from multi-storied buildings in event normal egress paths are blocked comprising a generally cylindrical tube of high strength plastic material of multi-story length of a diameter sufficient to freely receive persons entering one end feet first, said peripheral wall at one end of the chute being annularly reinforced at closely longitudinally spaced intervals by nonyielding, tear resisting, reinforcing bands adapted, upon return folding of said one end outwardly around a rigid annulus support member, to dispose said reinforcing bands into face butting engagement; annularly spaced securing grommets entered through said reinforcing bands and the intervening layers of said plastic material to fixedly secure said chute to said annulus; and respective semicylindrical resilient bands end connected to said tube of plastic material at respective diametrically opposed longitudinally spaced and aligned points, said resilient bands being of a substantially lesser length than the diameter of said fully open tube at said spaced and aligned points whereby the peripherally encircled areas at said spaced and aligned points will be inwardly restricted to yieldingly encompass the opposing portion of a freely descending person within said chute and decelerate or brake the speed of descent, means whereby the end of said escape chute remote from said one end secured to said annulus is fitted with annularly spaced strap hooks disposed in longitudinal alignment with the said restricted peripherally encircled areas; an elongated mattress-like cushion having connector straps extending from one end adapted to be normally secured to said strap hooks thereby connecting said mattress-like cushion in end-to-end spanning relation within said remote chute end of said chute; and means adapted to releasably secure said mattress-like cushion in supporting relation to said remote chute end upon endwise interfolding of said chute toward said one end to form a chute pack for storage when assembled on a rigid annulus support member.

2. An escape chute comprising a longitudinally folded annular open ended chute pack, a support frame for mounting the pack at a window opening or the like, means connecting the upper open end of the chute to said frame, means whereby the chute may be released to downwardly unfold so that the other end of said chute may be lowered toward the ground, longitudinally spaced diameter restriction means in said chute for successively periodically slowing the descent of a falling body that has entered the upper end of said chute, each of said longitudinally spaced restriction means comprising at least one semicircular resilient band secured around part of the circumference of the chute, the unrestricted regions in each semicircular band thus being smooth and uninterrupted to effectively prevent catching or snagging of a user's extremities such as the heels in the resilient bands as the user falls through the chute, and means whereby a cushion pad is attached to said chute in the pack at the lower open end of the chute in the pack at the lower open end of the chute so as to extend near the ground at an angle to the chute axis under and from the open end of the unfolded released chute to thereby receive said body in an inclined reclining position.

3. An escape chute assembly comprising a support, a chute pack comprising a longitudinally folded open tube of high strength flexible material having its upper open end secured to the support and including an elongated cushion pad extending across the lower end of the folded tube, releasable means normally retaining said tube in folded condition and the pad in assembly therewith on said support, a plurality of longitudinally spaced semicircular resilient bands secured to said tube whereby to provide semi-circumferentially restricted regions adapted to yieldingly encompass and periodically slow the descent of a body falling down through the tube when the chute is released, the unrestricting regions in each semicircular band area thus being smooth and uninterrupted to effectively prevent catching or snagging of a user's extremities such as the heels in the area of said bands as the user falls through the chute, and means whereby when the chute is released the cushion pad assumes a position wherein it underlies the open lower end of the tube and extends away therefrom toward the ground at an angle to thereby receive the falling body in a substantially reclining position.

4. The escape chute defined in claim 3, wherein the support comprises a frame adapted to be secured to a building at a window or the like and adjustable for locating the open upper end of the tube relative to the window or the like.

5. The escape chute defined in claim 10, wherein means is provided for regulating the distance of descent of the lower end of said tube.

6. The escape chute defined in claim 10, wherein the tube comprises nylon fabric sheeting.

* * * * *

UNITED STATES PATENT OFFICE

CERTIFICATE OF CORRECTION

Patent No. 4,099,595 Dated July 11, 1978

Inventor(s) Thomas Ray Tracy

It is certified that error appears in the above-identified patent and that said Letters Patent are hereby corrected as shown below:

Column 3, line 37, change bold type "1" to regular type --1--.

Column 3, line 38, change "8" to --18--.

Column 3, line 40, change bold type "24" to regular type --24--.

Column 3, line 41, change bold type "1" to regular type --1--.

Column 3, line 42, change bold type "27" to regular type --27--.

Column 3, line 42, change bold type "1" to regular type --1--.

Column 3, line 43, change bold type "28" to regular type --28--.

Column 3, line 45, change bold type "1 7/8" to regular type --1 3/4--.

Column 3, line 52, change bold type "2" to regular type --2--.

Column 6, line 32, change "structures" to --strictures--.

Claim 3, column 8, line 24, change "unrestricting" to --unrestricted--.

UNITED STATES PATENT OFFICE

CERTIFICATE OF CORRECTION

Patent No. 4,099,595 Dated July 11, 1978

Inventor(s) Thomas Ray Tracy

It is certified that error appears in the above-identified patent and that said Letters Patent are hereby corrected as shown below:

Claim 5, column 8, line 39, change "claim 10" to --claim 3--.

Claim 6, column 8, line 42, change "claim 10" to --claim 3--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*